US006557343B2

(12) United States Patent
Furudate

(10) Patent No.: US 6,557,343 B2
(45) Date of Patent: May 6, 2003

(54) PARTITION WALL ARRANGEMENT FOR EXHAUST DEVICES

(75) Inventor: Shigeru Furudate, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/971,800

(22) Filed: Oct. 9, 2001

(65) Prior Publication Data

US 2002/0040579 A1 Apr. 11, 2002

(30) Foreign Application Priority Data

Oct. 10, 2000 (JP) ..... 2000-309480

(51) Int. Cl.[7] ..... F01N 7/00
(52) U.S. Cl. ..... 60/324
(58) Field of Search ..... 60/322, 324, 323; 29/890.08

(56) References Cited

U.S. PATENT DOCUMENTS 3,574,358 A * 4/1971 Cassel ..... 181/212
4,002,026 A * 1/1977 Loffelhardt ..... 422/173
4,815,274 A * 3/1989 Piatti ..... 60/313
4,939,898 A * 7/1990 Ichimura et al. ..... 60/274

FOREIGN PATENT DOCUMENTS

| | | | | |
|---|---|---|---|---|
| DE | 2850614 | * | 4/1980 | ..... 60/323 |
| JP | 9-4451 | | 1/1997 | |
| WO | WO86/03256 | * | 6/1986 | ..... 60/323 |

* cited by examiner

*Primary Examiner*—Thomas Denion
*Assistant Examiner*—Diem Tran
(74) *Attorney, Agent, or Firm*—Armstrong, Westerman & Hattori, LLP

(57) ABSTRACT

In a partition wall arrangement for an exhaust gas pipe section including a partition wall including a main plate member separating the pipe section into two longitudinal passages, a reinforcing plate member is placed over and attached to a major surface of the partition wall member in a part adjacent to the upstream edge of the main plate member so that an improved durability is achieved through elimination of membrane vibrations. By providing an edge cover on the upstream edge of the partition wall, the partition wall can be protected from the adverse influences of the heat from the exhaust gas, and is reinforced even further.

11 Claims, 5 Drawing Sheets

4
13
16
17
24
15
22
33
9
34
36a
36b
23
29
27
20
25
21
30
28
35
32

PARTITION WALL ARRANGEMENT FOR EXHAUST DEVICES

BACKGROUND OF THE INVENTION

1. Field of the Invention

The present invention relates to a partition wall arrangement for an exhaust gas pipe for separating the interior of the pipe into a pair of longitudinally extending passages, and in particular to a partition wall arrangement for a pair of exhaust gas pipes which are coupled to each other by a flexible coupling such as a spherical coupling.

2. Description of the Related Art

An exhaust gas pipe at the converging end of an exhaust manifold for a multi cylinder engine and an exhaust pipe immediately downstream of the exhaust manifold are sometimes each separated into a pair of longitudinal passages each having a semicircular cross section by a corresponding partition wall for the purpose of avoiding exhaust gas interferences. Such a partition wall is exposed to the high temperature of the exhaust gas, and is therefore required to be able to withstand the resulting thermal stress (see Japanese patent laid-open publication No. 9-4451).

Also, in order to insulate the vibrations of the engine from being transmitted from the converging end of the exhaust manifold to the exhaust gas pipe in the downstream which is fixedly attached to the vehicle body, a spherical coupling is sometimes interposed between the converging end of the exhaust manifold and the exhaust gas pipe. The engine is typically mounted on rubber mounts to accommodate the vibratory motion of the engine. In such a case, the opposing edges of the partition walls of the converging end of the exhaust manifold and the exhaust gas pipe are spaced from each other so as to accommodate the relative flexing movement of the two parts that are joined by the spherical coupling. Therefore, a small gap is created between the opposing edges of the partition walls.

When the edges of the two partition walls oppose each other, and exhaust gas flows along the partition walls at high speed, the partition wall on the downstream side may vibrate as a membrane. This tendency is even more pronounced when the exhaust gas flow contains a pulsating component. This causes a repeated stress to the partition wall, and could severely impair the durability of the partition wall when combined with the effect of the high temperature of the exhaust gas.

SUMMARY OF THE INVENTION

In view of such problems of the prior art, a primary object of the present invention is to provide a partition wall arrangement for exhaust gas devices having an improved durability through elimination of membrane vibrations.

A second object of the present invention is to provide a partition wall arrangement for exhaust gas devices which is relatively free from the adverse influences of the heat of the exhaust gas.

A third object of the present invention is to provide a highly durable partition wall arrangement which is easy and economical to manufacture.

According to the present invention, such objects can be accomplished by providing a partition wall arrangement for an exhaust gas pipe section including a partition wall separating the pipe section into two longitudinal passages, the partition wall comprising: a main plate member extending diametrically across an inner circumferential surface of the pipe section and longitudinally over a certain length of the pipe section so as to define a pair of longitudinal passages inside the pipe section each having a semi-circular cross section; and a reinforcing plate member placed over and attached to a major surface of the partition wall member preferentially in a part adjacent to the upstream edge of the main plate member.

The reinforcing member is effective in reinforcing the partition wall, and raises the resonant frequency of the partition wall. This prevents the membrane vibration of the partition wall even when the exhaust gas flow contains pulsating components, and improves the durability of the partition wall. Because the reinforcement of the upstream edge of the reinforcing plate member is particularly effective in controlling the vibration, the reinforcing member may include a relatively broad upstream portion and a relatively narrow downstream portion so as to minimize the increase in the overall weight of the arrangement. For an added reinforcement, a second reinforcing member may be placed over and attached to the other major surface of the partition wall member preferentially over a part adjacent to the upstream edge of the pipe section.

Because the upstream edge of the partition wall is most exposed to the influence of the heat of the exhaust gas, it is preferable to provide an edge cover which is wrapped around upstream end edges of the reinforcing member and the main plate member. The edge cover may consist of a flange or an extension of the reinforcing member. Such an edge cover is also beneficial in reinforcing the edge portion of the partition wall, and in controlling the size of the gap between the opposing edges of the partition walls of two pipe sections which are connected to each other. Reducing the size of the gap contributes to the increase in the engine output and reducing the noises due to the interferences of the pressure pulsations between the different cylinders of the engine.

BRIEF DESCRIPTION OF THE DRAWINGS

The present invention is described in the following with reference to the drawings, in which.

DETAILED DESCRIPTION OF THE PREFERRED EMBODIMENTS

Figure 1:
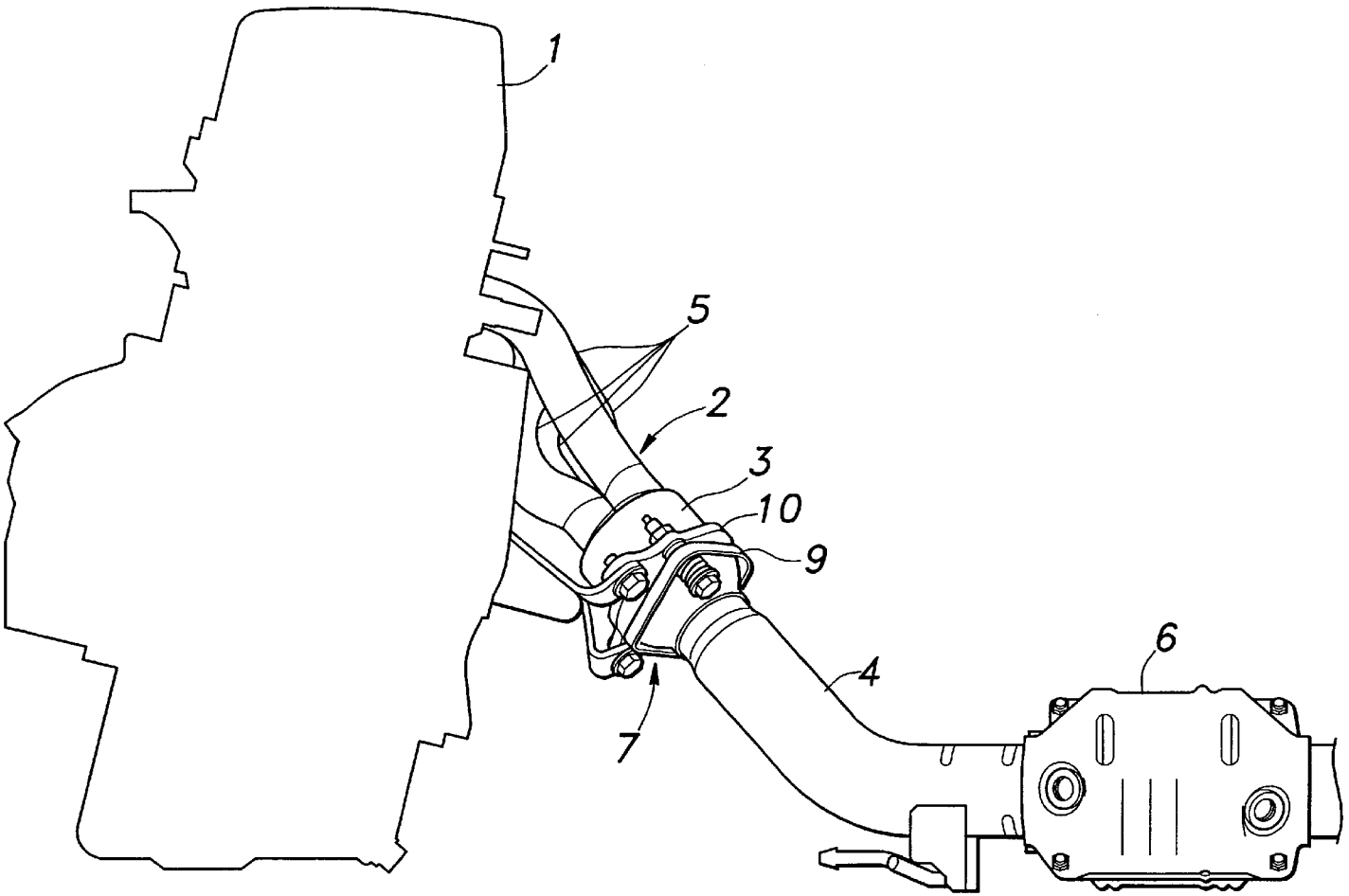
FIG. 1 is a perspective view of an exhaust device embodying the present invention.

Referring to FIG. 1, a multi cylinder engine 1 for an automobile is provided with an exhaust manifold 2. The converging end of the exhaust manifold 2 comprises an upstream exhaust pipe section 3, which is connected to a downstream exhaust pipe section 4 via a spherical coupling 7. The exhaust manifold 2 includes a plurality of branch pipes 5 which not only conduct exhaust gas from respective cylinders to the converging end but also mechanically secures the manifold 2 to the engine 1. The downstream exhaust pipe section 4 is attached to a vehicle body part (not shown in the drawing) via a bracket 6.

Figure 2:
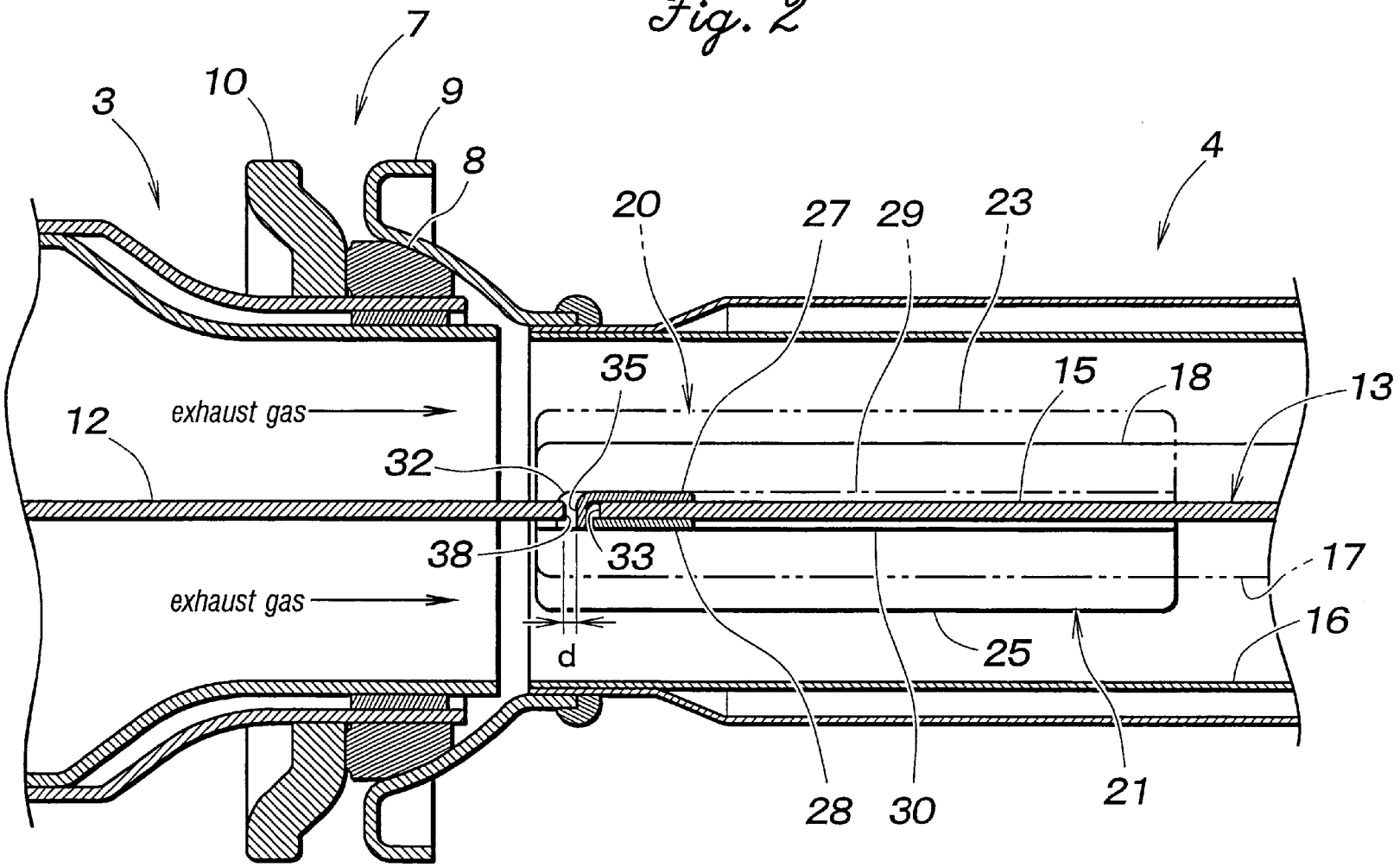
FIG. 2 is a longitudinal sectional view of a part of the exhaust device including a flexible joint coupling two pipe sections to each other.

Referring to FIG. 2, the spherical joint 7 comprises an annular gasket 8 which is tightly fitted on the upstream pipe section 3 and is provided with a spherical sliding surface on its outer surface. The opposing end of the downstream pipe section 4 is provided with a radial flange 9 consisting of a flared section of a pipe member which is welded to the upstream end of the downstream pipe section 4. A clamp ring 10 is fitted on the upstream pipe section 3 upstream of the gasket 8. The inner surface of the flange 9 abuts the spherical sliding surface of the annular gasket 8 in a complementary fashion, and the flange 9 and the clamp ring 10 are resiliently pulled toward each other by spring-loaded threaded bolts passed through the flange 9 and the clamp ring 10. The gasket 8 seals off the interior of the two pipe sections 3 and 4 from the outside, and the spherical sliding surface accommodates a mutual flexing or pivotal movement of the two pipe sections 3 and 4 in all directions.

Figure 3:
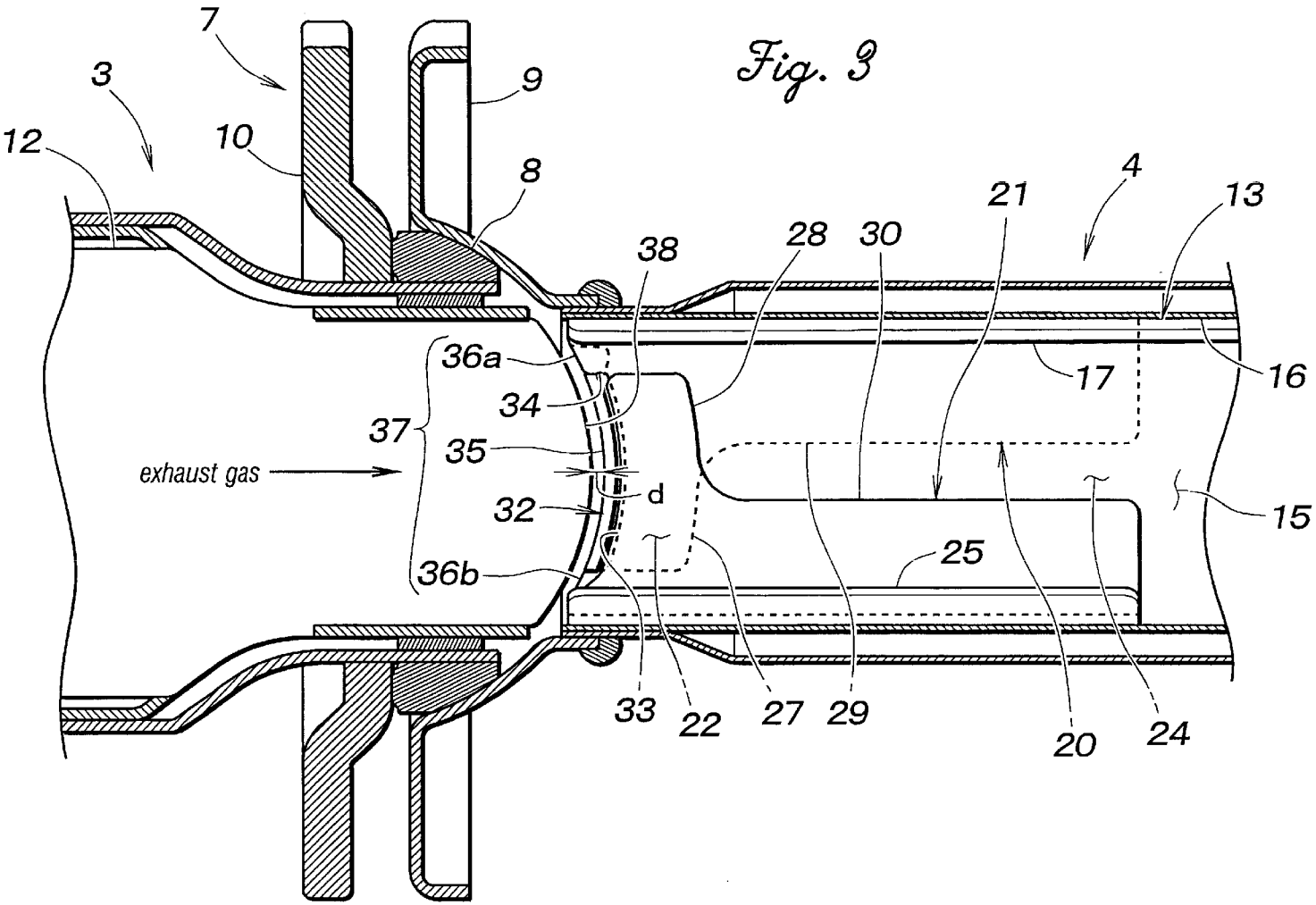
FIG. 3 is a longitudinal sectional view taken along a plane perpendicular to the sectional plane of FIG. 2.
Figure 4:
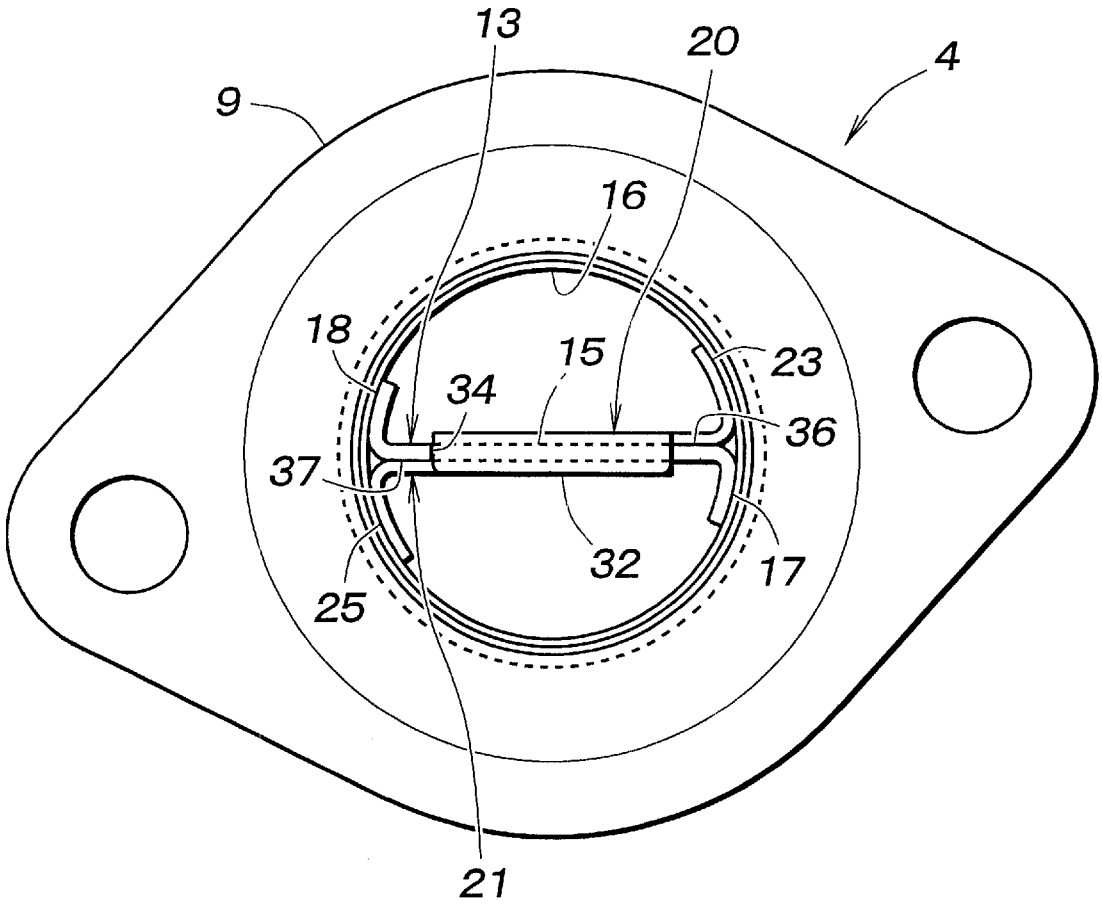
FIG. 4 is an end view of one of the exhaust pipe sections as seen from the flange end.
Figure 5:
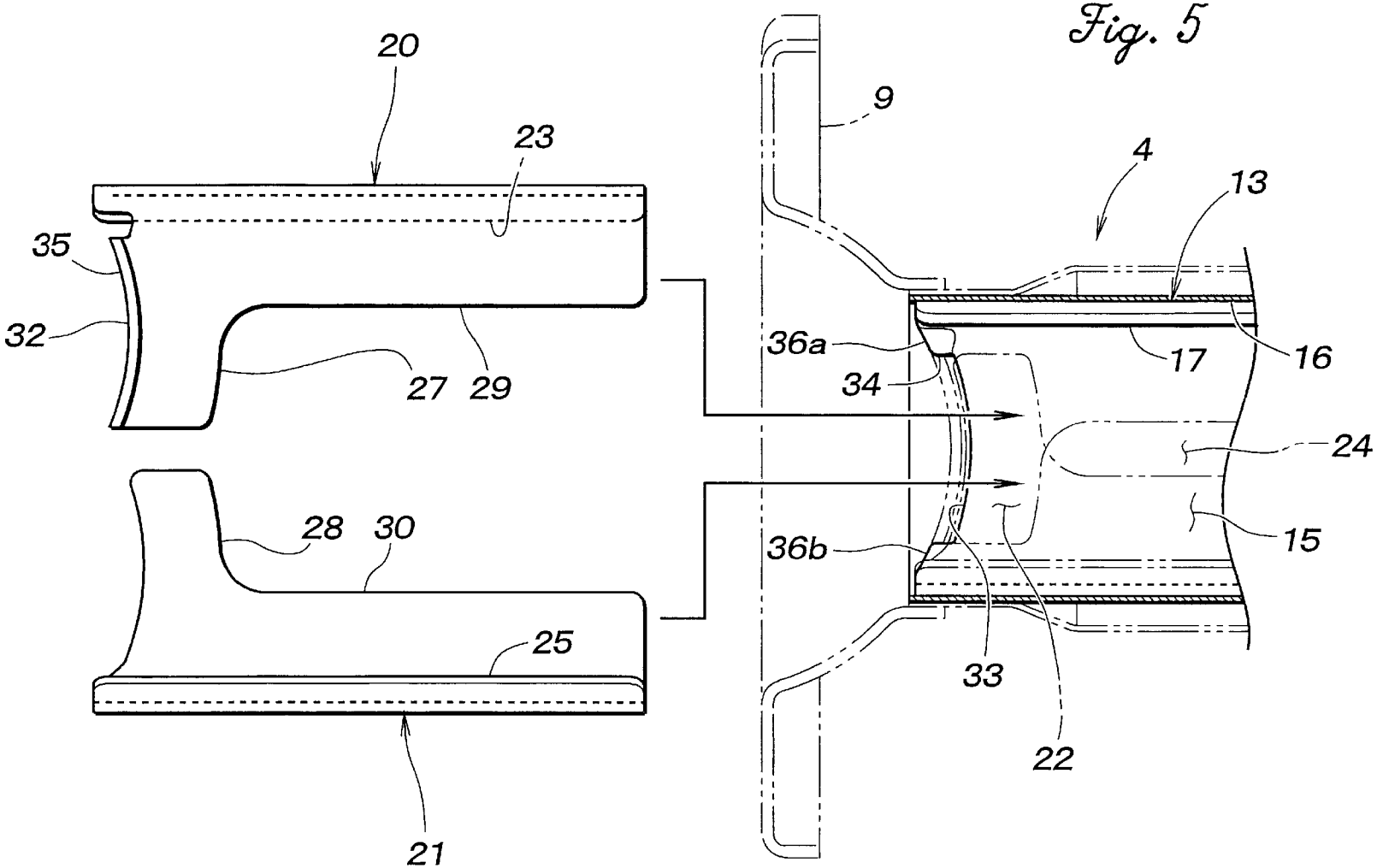
FIG. 5 is an exploded longitudinal sectional view of the exhaust pipe section shown in FIG. 4.

The two pipe sections are provided with partition walls 12 and 13 which separate the corresponding pipe sections into two longitudinal passages each having a semicircular cross section. As shown in FIG. 3, these partition walls 12 and 13 are aligned with each other, and are provided with opposing edges 37 and 38 that are separated from each other with a small gap d so as to accommodate the mutual flexing movement of the two pipe sections 3 and 4. In particular, the opposing edge 38 of the partition wall 12 of the upstream pipe section 3 is provided with a convex circular arcuate shape while the opposing edge 37 of the partition wall 13 of the downstream pipe section 4 is provided with a concave circular arcuate shape which is substantially complementary to the convex arcuate shape of the other partition wall 12. This arrangement accommodates the mutual flexing movement of the two pipe sections 3 and 4 while minimizing the gas communication between the two longitudinal passages.

The partition wall 13 of the downstream pipe section 4 comprises a main plate member 15 consisting of a simple plate member extending diametrically across the interior of the pipe section 4 and provided with a pair of side flanges 17 and 18 bent along either side edge in mutually opposite directions so as to conform to the opposing inner circumferential surface of the pipe section 4. These side flanges 17 and 18 abut the opposing surface of the pipe section 4 substantially without any gap, and are fixedly secured to the pipe section 4, for instance, by spot welding.

The partition wall 13 further comprises a pair of reinforcing plate members 20 and 21. Each reinforcing plate member 20 and 21 comprises a broader upstream portion 27 and 28, a narrower downstream portion 29 and 30 and a side flange 23 and 25 bent from a side edge extending straight substantially over the entire length of the reinforcing plate member away from the main plate member 15. The narrower downstream portions 29 and 30 have a width which is slightly greater than half the inner diameter of the pipe section 4 so that they slightly overlap each other as indicated by numeral 24. The broader upstream portions 27 and 28 have a width which is slightly smaller than the inner diameter of the pipe section 4 so that they overlap each other over a greater width as indicated by numeral 22.

Thus, the side flanges 17, 18, 23 and 25 are bent away from each other along either side of the partition wall 13, and abut the inner surface of the main plate member. These side flanges are attached to the pipe section, for instance, by spot welding. The narrower downstream portions 29 and 30 and broader upstream portions 27 and 28 are fixedly attached to the main plate member 15, for instance by jointly spot welding them together at the overlapping portions 22 and 24. Thus, the overlapping portions 22 and 24 including the central part of the upstream edge of the downstream partition wall consists of three layers of plate members.

The upstream end edge of the main plate member 15 is provided with a slightly recessed central edge 33, and a pair of shoulders 36*a* and 36*b* on either side thereof. The upstream edge of one of the reinforcing plate members 20 is provided with an end flange 32 which is bent over the recessed central edge 33 of the main plate member 15 and the end edge of the other reinforcing plate member 21 which is also somewhat recessed from the corresponding end edge of the one reinforcing plate member 20. The end flange 32 therefore serves as an edge cover that protects the edge of the partition wall 13 from the influences of the heat of the exhaust gas. The outer profile of the end flange 32 after being bent presents an outer end surface 35 which defines the circular arcuate edge 37 of the partition wall 13 jointly with the shoulders 36*a* and 36*b*. These edges as well as the flange are all provided with a corresponding concave circular arcuate shape. Thus, in the assembled state of the partition wall 13, the opposing edges 37 and 38 of the upstream and downstream partition walls 12 and 13 are provided with complementary circular arcuate shapes which are separated by the uniform gap d over the entire width.

The end flange 32 wraps around the corresponding edges of the main plate member 15 and the other reinforcing member 21, and protect them from the heat of the exhaust gas, and increases the rigidity of the upstream edge of the partition wall 13. More importantly, the reinforcing members 20 and 21 and the end flange 32 jointly reinforce (or increase the rigidity of) the upstream edge of the partition wall, and this can effectively prevent the undesired vibration of the partition wall 13.

It is preferable to provide the end flange 32 in the upper one of the partition wall members 20 and bend it downward to avoid accumulation of residual substances at the edge of the end flange. Also, the reinforcing plate member 20 provided with the end flange 32 may be provided with a smaller thickness than the other reinforcing plate member 21 or may be made of a different material to simplify the work of bending the end flange 32. In the foregoing embodiment, each reinforcing member included a narrow section 29 and 30 and a broad section 27 and 28 so as to define the shape of letter-L, but may also be provided with other tapering shapes such as a triangle.

Although the present invention has been described in terms of preferred embodiments thereof, it is obvious to a person skilled in the art that various alterations and modifications are possible without departing from the scope of the present invention which is set forth in the appended claims.

What is claimed is:

1. A partition wall arrangement for an exhaust gas pipe section including a partition wall separating said pipe section into two longitudinal passages, said partition wall comprising:

a main plate member extending diametrically across an inner circumferential surface of said pipe section and longitudinally over a certain length of said pipe section so as to define a pair of longitudinal passages inside said pipe section each having a semi-circular cross section; and a reinforcing plate member placed over and attached to a major surface of said partition wall member in a part adjacent to said upstream edge of said main plate member.

2. A partition wall arrangement according to claim 1, wherein a second reinforcing member is placed over and attached to the other major surface of said partition wall member over a part adjacent to said upstream edge of said pipe section.

3. A partition wall arrangement according to claim 2, wherein said second reinforcing plate member includes a relatively broad upstream portion and a relatively narrow downstream portion.

4. A partition wall arrangement according to claim 1, further comprising an edge cover which is wrapped around upstream end edges of said reinforcing member and said main plate member.

5. A partition wall arrangement according to claim 1, wherein said reinforcing plate member comprises an edge cover consisting of an end flange provided in an upstream end edge of said reinforcing member and bent around the upstream end edge of said main plate member.

6. A partition wall arrangement according to claim 2, further comprising an edge cover which is wrapped around upstream end edges of said reinforcing members and said main plate member.

7. A partition wall arrangement according to claim 6, wherein said edge cover comprises an edge cover consisting of an end flange provided in an upstream end edge of said first reinforcing member and bent around the upstream end edges of said main plate member and second reinforcing member.

8. A partition wall arrangement according to claim 1, wherein said reinforcing plate member is provided with a side flange which is bent away from the main plate member and is attached to the inner surface of said pipe section.

9. A partition wall arrangement according to claim 1, wherein said main plate member is provided with a side flange which is bent away from the reinforcing plate member, and is fixedly attached to the inner surface of said pipe section.

10. A partition wall arrangement according to claim 1, wherein said pipe section is connected to another pipe section having a corresponding partition wall via a pipe coupling.

11. A partition wall arrangement according to claim 10, wherein said pipe coupling consists of a flexible coupling, and opposing edges of said partition walls are provided with circular arcuate shapes which are substantially complementary to each other.

* * * * *